United States Patent [19]

Jörns et al.

[11] Patent Number: 4,559,087

[45] Date of Patent: Dec. 17, 1985

[54] PROCESS FOR PHOSPHATING METALS

[75] Inventors: Peter Jörns; Norbert Meyer; Werner Rausch; Josef Rothkegel; Gunther Luckhardt; Gudrun Volling, all of Frankfurt, Fed. Rep. of Germany

[73] Assignee: Parker Chemical Company, Madison Heights, Mich.

[21] Appl. No.: 600,587

[22] Filed: Apr. 17, 1984

[30] Foreign Application Priority Data

Apr. 26, 1983 [DE] Fed. Rep. of Germany ..... 3315086

[51] Int. Cl.[4] ..... C23F 7/12

[52] U.S. Cl. ..... 148/6.15 Z

[58] Field of Search ..... 148/6.15 Z

[56] References Cited

U.S. PATENT DOCUMENTS 4,292,096 9/1981 Murakami ..... 148/6.15 Z 4,400,416 8/1983 Takahashi ..... 148/6.15 Z

OTHER PUBLICATIONS

EP 0018841, 11/80.

*Primary Examiner*—Sam Silverberg

*Attorney, Agent, or Firm*—Arthur E. Kluegel

[57] ABSTRACT

In a process for phosphating composite metals containing steel and zinc surfaces using phosphating solutions based on zinc phosphate by the dipping process, in order to achieve satisfactory formation of the phosphate layer, the composite metals are subjected to preliminary dipping for a maximum of 30 seconds in a phosphating solution based on zinc phosphate in order to initiate the formation of the phosphate layer, and are then conveyed to the main dip-phosphating zone.

It is advantageous to spray the composite metals with a phosphating solution based on zinc phosphate while they are being conveyed from the preliminary to the main dip-phosphating zone, and it is advisable to limit the duration of the conveying and thus of the spraying treatment to a maximum of 30 seconds.

1 Claim, No Drawings

PROCESS FOR PHOSPHATING METALS

BACKGROUND OF THE INVENTION

The invention relates to a process for phosphating composite metals containing steel and zinc surfaces and having cavities, using phosphating solutions based on zinc phosphate, by the dipping process.

Steel sheets having an improved surface, in particular galvanized steel sheets, composite metals as they are called, are becoming increasingly important in industrial mass production. Composite metals of this type are obtained by joining steel sheets and galvanized steel sheets and also by partially galvanizing steel sheets. Before painting, especially application of paint by electrodeposition, phosphating with solutions based on zinc phosphate in order to improve corrosion resistance and adhesion of paint is necessary, just as it is for components containing only steel or zinc surfaces.

The special feature in the phosphating of composite metals containing zinc and steel surfaces is the fact that, when contact takes place with the phosphating solution, particularly in dip treatment, an electrochemical cell is formed, with the zinc surface as the anode and the steel surface as the cathode. As a result, in the immediate neighborhood of the zinc surface, the cathodic current density on the steel surface is so high that the phosphating process is adversely affected (W. Rausch, "Chemische Oberflachenbehandklung von verzinktem und zinkstaublackiertem Stahl fur die kathodische Elektrotauchlackierung" ("The chemical surface treatment of galvanized steel and steel painted with zinc dust for the application of paint by cathodic electrodeposition") Industrie Lackierbetrieb 49 (1981), pages 413 et seq.).

Thus, in phosphating by dipping, the formation of a phosphate layer is interfered with to such an extent that, depending on the phosphating process, a strip about 5 to 10 mm wide, carrying a very translucent and only incompletely formed phosphate layer, is formed on the steel side.

Spraying and spraying/dipping processes present fewer difficulties because the formation of an electrochemical cell is incomplete. The strip mentioned above is generally not formed, but the whole phosphate layer is frequently streaky and has an adverse effect on the paint system subsequently applied.

Specifically for the treatment of composite metals of the type mentioned above, it is known to carry out treatment, first by dipping and then by spraying, using phosphating solutions containing 0.5 to 1.5 g/liter of zinc, 5 to 30 g/liter of phosphate ions, 0.6 to 3 g/liter of manganese ions and customary accelerators (European Laid-Open Specification 60,716). The dipping treatment should in this case be at least 15 seconds, advantageously 0.5 to 2 minutes, and the spraying treatment should be at least 2 seconds, advantageously 5 to 45 seconds. Even using this process, composite metals containing cavities cannot be phosphated in a satisfactory manner.

The object of the invention is to provide a process, for phosphating composite metals containing steel and zinc surfaces and having cavities, which does not have the disadvantages of the processes mentioned above, but results in a satisfactory, continuous phosphate layer—without additional outlay on the process.

SUMMARY OF THE INVENTION

This object is achieved by modifying, in accordance with the invention, the process of the type mentioned initially in such a way that the composite metals are dipped beforehand, into a phosphating solution based on zinc phosphate for not more than 30 seconds in order to initiate the formation of the phosphate layer, and are then conveyed to the zone of actual dip-phosphating.

DETAILED DESCRIPTION OF THE INVENTION

Any desired phosphating solutions based on zinc phosphate can be employed for carrying out the phosphating process. They can form part of either the so-called low-zinc technology or of the standard zinc technology. This means that the composite metals can be brought in contact with a phosphating solution in which the weight ratio of Zn to $P_2O_5$ has been adjusted to 1:(8 to 85), or with a phosphating solution in which the weight ratio of Zn to $P_2O_5$ has been adjusted to 1:(0.3 to 7).

In the first case, phosphate layers having a high proportion of phosphophyllite to hopeite are formed on the steel. These coatings are particularly suitable, because of their excellent corrosion resistance, as a preparatory treatment for painting, the best protective properties being achieved in conjunction with the application of paint by cathodic electrodeposition.

In the second case, the result is phosphating processes which are distinguished by a higher phosphating speed compared with the low-zinc processes. The phosphate layers produced by means of them have good properties for a wide spectrum of uses in the fields of corrosion resistance and cold deformation without machining.

The aqueous acid solutions, to be used within the scope of the invention, based on zinc phosphate contain primary zinc phosphate and a certain amount, adjusted to suit the particular bath concentration, mode of use and bath temperature, of free acid. The pH of the baths is, for instance, between 2.0 and 3.9, depending on the process conditions.

The baths can also contain further cations which are known in the technology of phosphating, for example Ni, Co, Cu, Mn, Ca, Mg, Fe, Na, K, Li, $NH_4$ and others. In order to adjust the acidity and to achieve special technical effects, it can be necessary or desirable to use concomitantly further anions other than phosphate, for example $NO_3$, $ClO_3$, Cl, $SO_4$, F, $BF_4$, $SiF_6$, citrate, tartrate and others.

The contact time for the phosphating solution used in the final dip treatment is usually between 1 and 10 minutes. The temperature of the phosphating solution is about 30° to 60° C. The lower the temperature, the longer, usually, is the contact time.

An advantageous embodiment of the invention consists in spraying the composite metals with a phosphating solution based on zinc phosphate while they are being conveyed to the zone of dip-phosphating, and, furthermore, limiting the conveying to the zone of dip-phosphating, and thus the spraying treatment, to a maximum of 30 seconds.

This procedure has the advantage that, during the transfer of the metal surface to the final dip-treatment, fresh phosphating solution is available for forming an unvarying film of liquid on the metal surface. This prevents liquid films of different thicknesses being present on the metal surface as a result of the liquid draining off.

The advantage of the above-mentioned measure manifests itself particularly in the formation of uniform phosphate layers.

In other respects, the measures customary in connection with phosphating processes are also applicable in the case of the present process. These are, in particular, degreasing and rust removal, preliminary rinsing to activate the formation of the phosphate layer, and after-treatment with re-rinsing solutions based on Cr (VI) and/or Cr (III) etc., or with impregnating agents, such as rustproofing oils or waxes and synthetic resins.

When phosphating solutions based on zinc phosphate are mentioned in the above statements in connection with the actual dip-treatment, the brief dipping prior to transfer and the spraying treatment while the composite metals are conveyed to the dip-treatment, these solutions are usually solutions of essentially the same composition. Certain deviations are, as a rule, mainly the consequence of varying exhaustion of the phosphating solution and of the increased precipitation of iron caused by the action of atmospheric oxygen in the spraying treatment.

The invention is exemplified and illustrated in more detail on the basis of the examples.

EXAMPLES

Composite metals composed of steel sheet and galvanized steel sheet were treated by the following procedures.

(1) Preliminary cleaning using an alkaline cleaner at 60° C., spraying for 4 minutes.
(2) Main cleaning using the same cleaner at 80° C.; dipping for 9.5 minutes.
(3) Rinsing with cold water by dipping.
(4) Activation by means of a titanium phosphate solution for 1 minute by dipping.
(5) Phosphating at 60° C. using a solution containing:
  1.5 g/liter of Zn
  0.4 g/liter of Ni
  22.5 g/liter of $P_2O_5$ and
  0.14 g/liter of $NaNO_2$,
  and containing 1.6 to 1.7 points of free acid, 36 points of total acid and also an S-value acid of 0.05 to 0.06.
(6) Rinsing with cold water by dipping.
(7) Re-rinsing with a CrIII/CrVI solution by dipping.
(8) Drying in an oven for 15 minutes.

Under identical conditions in respect of stages 1 to 4 and 6 to 8, the dipping and spraying times within the phosphating stage were varied in accordance with the entries in the table below.

| | Phosphating | | | Layer Formation on Steel | |
|---|---|---|---|---|---|
| | Preliminary Dipping | Preliminary Spraying | Dipping | at the border with the zinc | on the surface |
| 1. | — | — | 4 minutes | translucent | continuous |
| 2. | — | 10 seconds | 4 minutes | continuous | streaky |
| 3. | — | 20 seconds | 4 minutes | continuous | streaky |
| 4. | — | 30 seconds | 4 minutes | continuous | streaky |
| 5. | 25 seconds | 10 seconds | 4 minutes | continuous | continuous |
| 6. | 25 seconds | 20 seconds | 4 minutes | continuous | continuous |
| 7. | 25 seconds | 30 seconds | 4 minutes | continuous | continuous |
| 8. | 50 seconds | 10 seconds | 4 minutes | translucent | continuous |
| 9. | 50 seconds | 20 seconds | 4 minutes | translucent | continuous |
| 10. | 50 seconds | 30 seconds | 4 minutes | translucent | continuous |
| 11. | 70 seconds | 10 seconds | 4 minutes | translucent | continuous |
| 12. | 70 seconds | 20 seconds | 4 minutes | translucent | continuous |
| 13. | 70 seconds | 30 seconds | 4 minutes | translucent | continuous |

The tests show that, with dip-phosphating (1) alone, a strip having only an incompletely formed and therefore translucent phosphate layer is obtained at the boundary with the zinc surface. Although this strip is satisfactorily phosphated and carries a continuous phosphate layer if a spraying treatment is carried out beforehand (2 to 4), the whole surface of the steel is covered with streaky phosphate layers.

With an additional preliminary dipping corresponding to the process according to the invention (5 to 7), the formation of the phosphate layer is satisfactory both near to the zinc surface and on the whole surface of the steel. Although the phosphate layer on the surface of the steel remains continuous with a longer preliminary dipping, it is incompletely formed and is translucent within the zone of action of the zinc surface.

What is claimed is:

1. A process suitable for phosphating composite metal articles containing steel and zinc surfaces, using phosphating solutions based on zinc phosphate by the dipping process, which comprises (1) subjecting the composite metal article to a preliminary dipping in a zinc phosphate solution of not more than 30 seconds, (2) spraying the composite metal articles with a phosphating solution based on zinc phosphate while they are being conveyed from the preliminary dipping zone to the main dip-phosphating zone wherein the conveying time from the preliminary to the main dip-phosphating zone is limited to a maximum of 30 seconds, (3) subjecting the partially coated article to the main dip-phosphating in a zinc phosphate solution for a contact time between 1 and 10 minutes.

* * * * *